US007307593B2

(12) United States Patent
Ieda et al.

(10) Patent No.: US 7,307,593 B2
(45) Date of Patent: Dec. 11, 2007

(54) ANTENNA DEVICE

(75) Inventors: Kiyokazu Ieda, Chiryu (JP); Kazuyoshi Mori, Chita (JP); Eiji Mushiake, Chita-gun (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 15 days.

(21) Appl. No.: 11/331,009

(22) Filed: Jan. 13, 2006

(65) Prior Publication Data

US 2006/0164311 A1 Jul. 27, 2006

(30) Foreign Application Priority Data

Jan. 26, 2005 (JP) ..... 2005-018437

(51) Int. Cl.

| | |
|---|---|
| ***H01Q 1/32*** | (2006.01) |
| ***H01Q 1/00*** | (2006.01) |
| ***H01Q 1/42*** | (2006.01) |
| ***H01Q 1/36*** | (2006.01) |

(52) U.S. Cl. ..... 343/713; 343/787; 343/872; 343/895

(58) Field of Classification Search ..... 343/711–713, 343/787, 788, 895, 872

See application file for complete search history.

(56) References Cited

U.S. PATENT DOCUMENTS

| | | | | |
|---|---|---|---|---|
| 3,154,281 | A | 10/1964 | Frank | |
| 3,294,347 | A | 12/1966 | Mongesku et al. | |
| 4,275,400 | A | 6/1981 | Miyakoshi | |
| 6,400,330 | B1 * | 6/2002 | Maruyama et al. | 343/788 |
| 6,664,936 | B2 * | 12/2003 | Ieda et al. | 343/866 |
| 6,812,823 | B2 | 11/2004 | Inaba et al. | |
| 7,167,140 | B2 * | 1/2007 | Kato et al. | 343/788 |
| 2002/0033777 | A1 | 3/2002 | Maruyama et al. | |
| 2005/0006909 | A1 | 1/2005 | Tanimoto et al. | |

FOREIGN PATENT DOCUMENTS

| | | | |
|---|---|---|---|
| JP | 2001-345615 | A | 12/2001 |
| JP | 3509790 | B2 | 1/2004 |
| WO | WO 02/23668 | A1 | 3/2002 |

OTHER PUBLICATIONS

European Search Report dated May 16, 2006.

* cited by examiner

*Primary Examiner*—Shih-Chao Chen
(74) *Attorney, Agent, or Firm*—Buchanan Ingersoll & Rooney PC

(57) ABSTRACT

An antenna device includes a core portion made of magnetic material, a wire coiled around the core portion leaving a leading end portion by a predetermined length, a case holding the core portion on which the wire is coiled and fixed on a body of a vehicle, and an elastic member provided between the core portion and the case for holding the core portion relative to the case.

20 Claims, 6 Drawing Sheets

ANTENNA DEVICE

CROSS REFERENCE TO RELATED APPLICATIONS

This application is based on and claims priority under 35 U.S.C. §119 with respect to Japanese Patent Application No. 2005-018437 filed on Jan. 26, 2005, the entire content of which is incorporated herein by reference.

FIELD OF THE INVENTION

The present invention relates to an antenna device.

BACKGROUND

An antenna which establishes communication between an electronic key which an owner of a vehicle carries and a vehicle is provided on a smart entry system. A known antenna is described in JP2001-345615A.

The known antenna includes a ferrite member and an electric conductive wire. The antenna is made by coiling an electric conductive wire around a ferrite member, and is housed in a case which is made of resin. Potting material (i.e., resin) is injected into the case in order to hold the antenna and to waterproof the antenna.

Generally, ferrite includes low mechanical intensity and is likely to break. Accordingly, the antenna made of ferrite is required to be provided with resistance to vibration and resistance to impact by another means. Further, with an antenna including a core portion made of magnetic material other than ferrite, it is also favorable that the antenna is provided with resistance to vibration and resistance to impact considering that the antenna is mounted on a vehicle. With the known antenna described in JP2001-345615A, the ferrite member is protected from oscillation and impact by means of potting material injected into the case.

Notwithstanding, potting material requires cure time. In other words, a waiting time during which operation is not conducted is generated until the potting material is cured in a series of assembling operation from inserting the antenna in the case to holding the antenna in the case. Thus, in terms of a view for productivity (i.e., ease of assembly), there is room for improvement.

A need thus exists for an antenna device which can reduce man-hour for assembling an antenna.

SUMMARY OF THE INVENTION

In light of the foregoing, the present invention provides an antenna device, which includes a core portion made of magnetic material, a wire coiled around the core portion leaving a leading end portion by a predetermined length, a case holding the core portion on which the wire is coiled and fixed on a body of a vehicle, and an elastic member provided between the core portion and the case for holding the core portion relative to the case.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

One embodiment of the present invention will be explained with reference to illustrations of drawing figures as follows.

Figure 1:
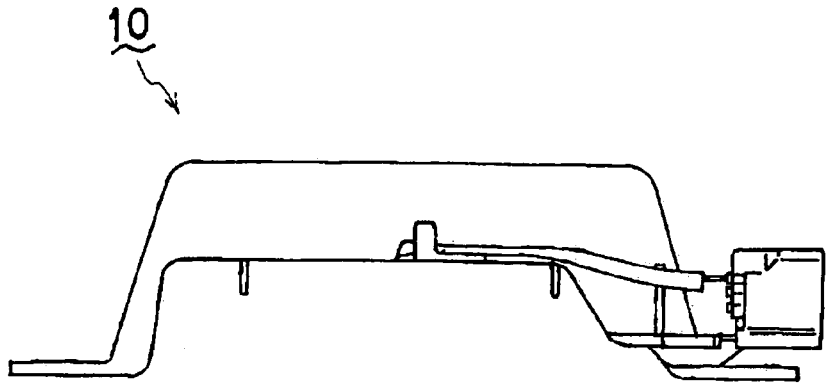
FIG. 1 is a front view showing an overview of a bumper antenna according to an embodiment of the present invention.
Figure 2:
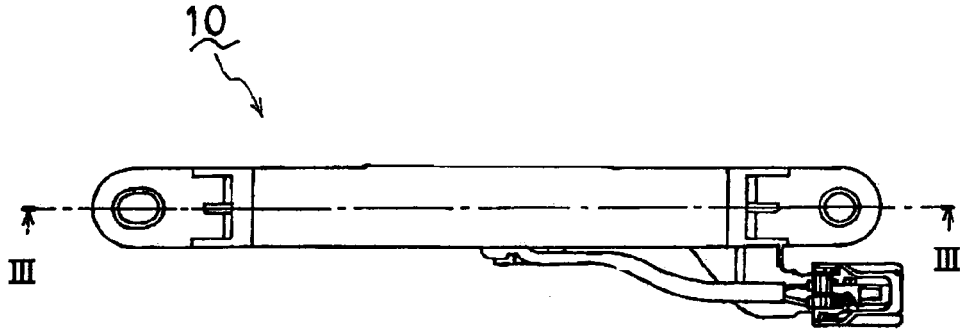
FIG. 2 is a top view showing an overview of the bumper antenna according to the embodiment of the present invention.

As shown in FIG. 1, a bumper antenna, or a trunk antenna (i.e., serving as an antenna device) 10 is one of parts which construct a smart entry system. The bumper antenna 10 locks and unlocks an opening and closing body such as a backdoor, trunk lid, or the like, which covers luggage space without operating switches of a remote controller and without operating a mechanical key. The bumper antenna 10 is provided in the vicinity of the luggage space for a vehicle.

When a user who has an electronic key pushes a switch which is provided in the vicinity of the opening and closing body when the opening and closing body is locked, electric wave is transmitted from the vehicle to the electronic key via the bumper antenna 10. Receiving the electric wave at the electronic key, an ID code is identified between the electronic key and the vehicle, and when the ID code is matched, the opening and closing body is unlocked.

The bumper antenna 10 includes a bar antenna 11 and a case 20.

The bar antenna 11 establishes communication between the vehicle and the electronic key which the user of the vehicle carries. The case 20 holds the bar antenna 11 through an elastic member 30 and is fixed to a body panel 9 (body of the vehicle) in a bumper cover of the vehicle. The detailed construction of the bar antenna 11, the case 20, and the elastic member 30 will be explained as follows referring to FIGS. 4-7.

The bar antenna 11 includes an antenna core 12 and a wire 13.

The antenna core 12 (i.e., serving as a core portion) is, for example, made of ferrite which is one of magnetic materials, and is formed in a bar shape. The wire 13 (i.e., insulated wire) includes a wire core which is formed by twisting copper wires and covering material made of insulator for covering the wire core. The wire 13 is coiled around the antenna core 12. With the foregoing construction, a predetermined length of leading end portion 14 is provided at ends of the wire 13. The core portion may be made of soft magnetic materials such as cobalt amorphous, ferrous amorphous, amorphous alloy, nanocrystal magnetic alloy other than ferrite. Further, the core portion may be made from layers of magnetic ribbons which are made of materials mentioned above.

The case 20 includes a body 21 and a cover 22.

Figure 3:
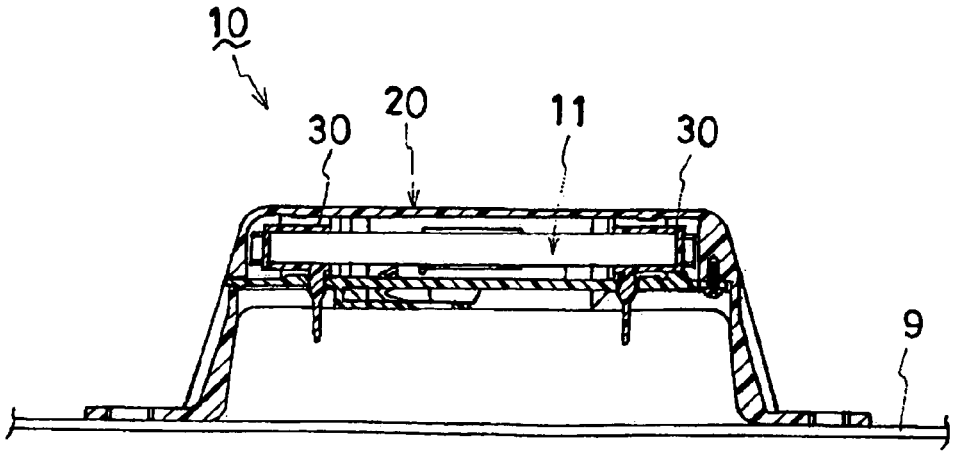
FIG. 3 is a cross-sectional view taken on line III-III of FIG. 2.
Figure 4:
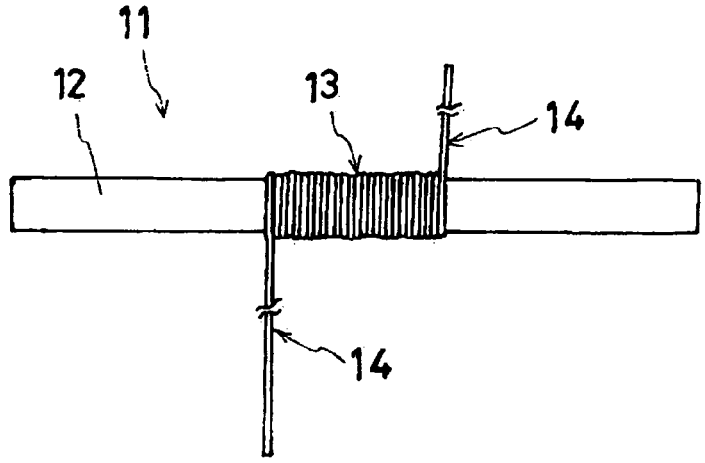
FIG. 4 is a view showing a structure of a bar antenna.
Figure 5A:
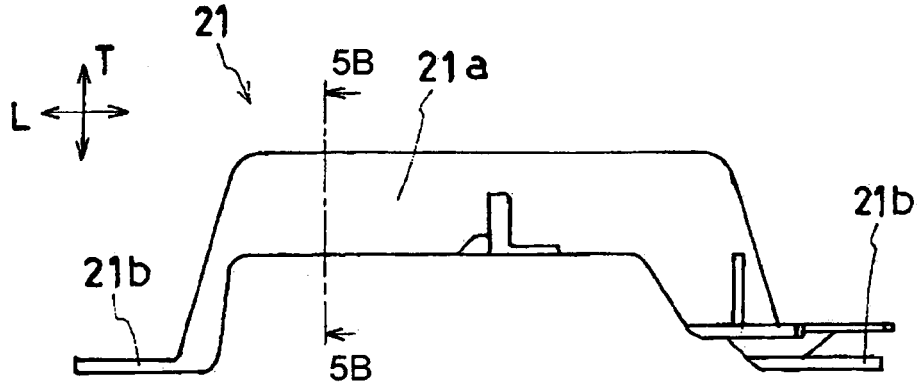
FIG. 5A is a front view of a body of a case according to the embodiment of the present invention.
Figure 5B:
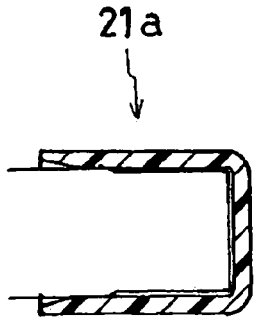
FIG. 5B is a cross-sectional view taken on line 5B-5B of FIG. 5A.
Figure 6A:
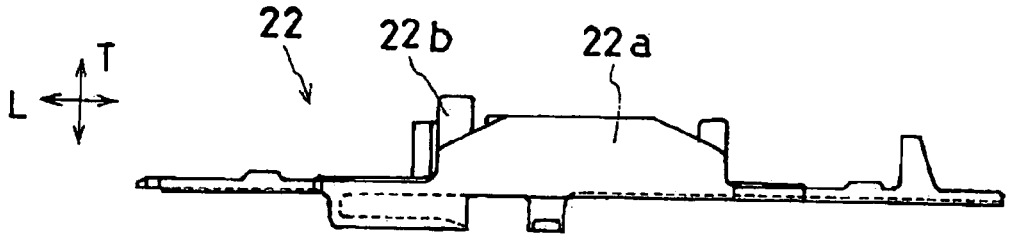
FIG. 6A is a front view of a cover showing structure of the cover of the case according to the embodiment of the present invention.
Figure 6B:
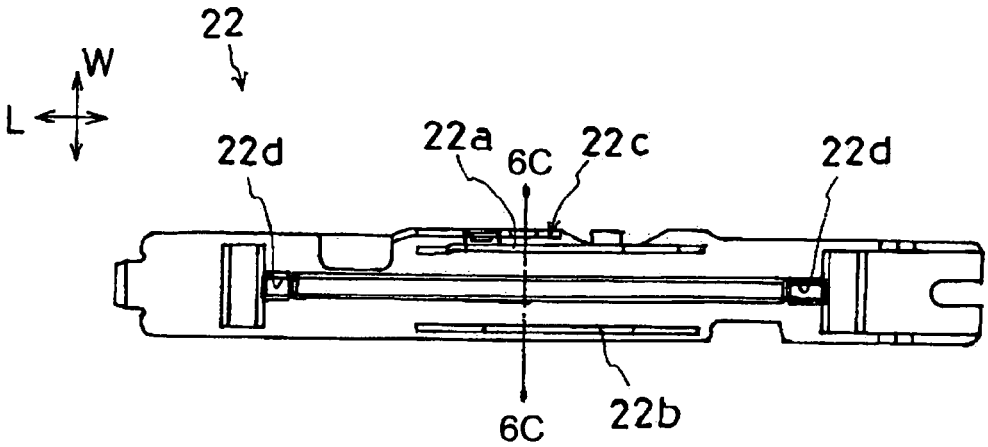
FIG. 6B is a top view of the cover according to the embodiment of the present invention.
Figure 6C:
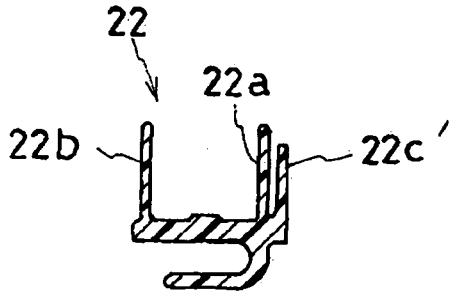
FIG. 6C is a cross-sectional view taken on line 6C-6C of FIG. 6B.
Figure 7A:
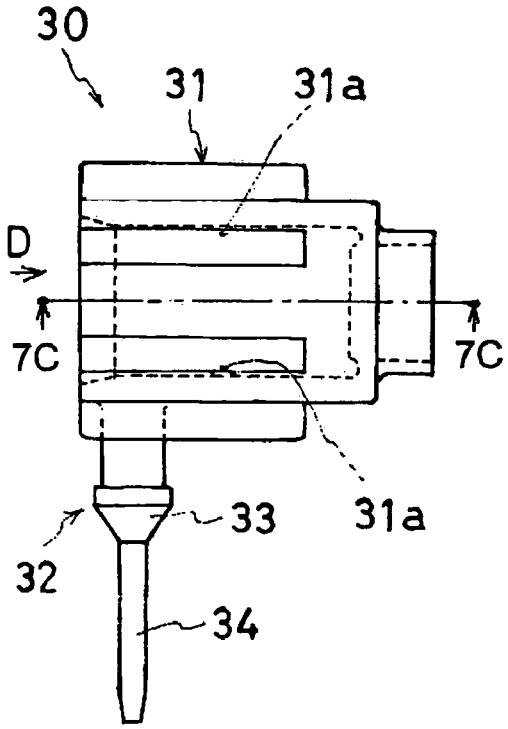
FIG. 7A is a front view of an elastic member according to the embodiment of the present invention.
Figure 7B:
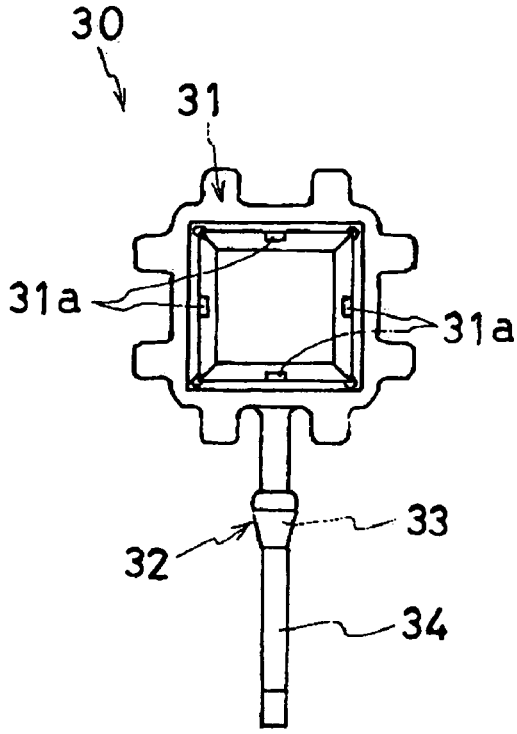
FIG. 7B is a view viewed from arrow D of FIG. 7A.
Figure 7C:
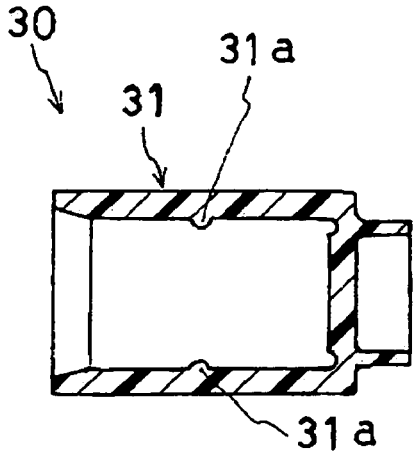
FIG. 7C is a cross-sectional view taken on line 7C-7C of FIG. 7A.

The body 21 made of resin is shaped into approximately long shape. The body 21 includes a housing portion 21*a* and a fixing portion 21*b*. The housing portion 21*a* is shaped to have a recess in a thickness direction of the body 21 (i.e., direction T of FIG. 5A). The fixing portion 21*b* is provided at each side of the body 21 in a longitudinal direction of the body 21 (i.e., direction L of FIG. 5A). The body 21 is fixed on a body panel 9 (shown in FIG. 3) using a tightening member such as a bolt.

The cover 22 made of resin likewise the body 21 is formed in approximately long and thin plate shape. The cover 22 is configured to be fitted into the body 21. The cover 22 and the body 21 are fitted each other so that a thickness direction of the body 21 is arranged corresponding to a thickness direction of the cover 22 (i.e., direction T of FIG. 6A), and a longitudinal direction of the body 21 is arranged corresponding to a longitudinal direction of the cover 22 (i.e., direction L of FIG. 6A).

The cover 22 is formed with opposing wall portions 22*a*, 22*b*, a holding portion 22*c*, and an attaching hole 22*d*.

The opposing wall portions 22*a*, 22*b* are provided at each side in a width direction (i.e., direction W of FIG. 6B) of the cover 22, and are arranged opposing each other. The opposing wall portions 22*a*, 22*b* are extended in a thickness direction of the cover 22. The bar antenna 11 is held between the opposing wall portions 22*a*, 22*b*.

The holding portion 22*c* is provided facing the opposing wall portion 22*a*. The holding portion 22*c* includes a groove formed in a thickness direction of the cover 22. The leading end portion 14 of the wire 13 of the bar antenna 11 is housed in the groove of the holding portion 22*c*. Thus, the leading end portion 14 of the wire 13 is held relative to the cover 22.

The attaching hole 22*d* is provided at each end of the cover 22 in a longitudinal direction of the cover 22. The attaching hole 22*d* is penetrated through the cover 22 in the thickness direction. The elastic member 30 is fitted into the attaching hole 22*d*. The construction of the elastic member 30 will be explained referring to FIG. 7.

The elastic member 30 is made from an elastic body made of such as rubber and elastomer. The elastic member 30 is formed approximately in box shape (i.e., a case having a bottom). The elastic member 30 includes a fitting portion 31 and an attaching portion 32.

The fitting portion 31 includes a recess portion formed in right and left direction (i.e., right, left direction of FIG. 7A) of the elastic member 30. The antenna core 12 of the bar antenna 11 is fitted into the fitting portion 31 to be assembled. A projection 31*a* is formed on an internal surface of the fitting portion 31. When the antenna core 12 of the bar antenna 11 is fitted into the fitting portion 31, the projection 31 a presses the outer surface of the antenna core 12. In other words, the antenna core 12 is press-fitted into the fitting portion 31.

The attaching portion 32 is unitarily formed on the fitting portion 31, and extends in upward and downward direction (i.e., upward and downward direction of FIG. 7A) of the elastic member 30. The elastic member 30 is fitted to the attaching hole 22*d* of the cover 22 at the attaching portion 32.

The attaching portion 32 is provided with a wedge portion 33 and a handle portion 34 in order nearside of fitting portion 31.

The wedge portion 33 is tapered in a downward direction (i.e., downward direction of FIG. 7A) of the elastic member 30, and is shaped approximately in wedge shape. When the elastic member 30 is fitted to the attaching hole 22*d* of the cover 22, the wedge portion 33 is fitted to the attaching hole 22*d* of the cover 22.

The handle portion 34 is formed at an end of the wedge portion 33, and is formed in a pin shape. When the elastic member 30 is fitted to the attaching hole 22*d* of the cover 22, the handle portion 34 is inserted into the attaching hole 22*d* of the cover 22 before the wedge portion 33.

Figure 9:
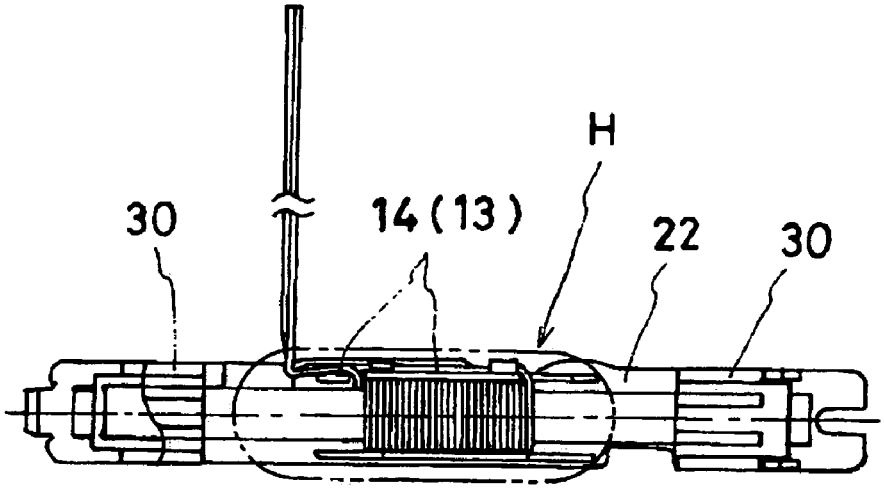
FIG. 9 is a view viewed from arrow G of FIG. 8C.
Figure 10:
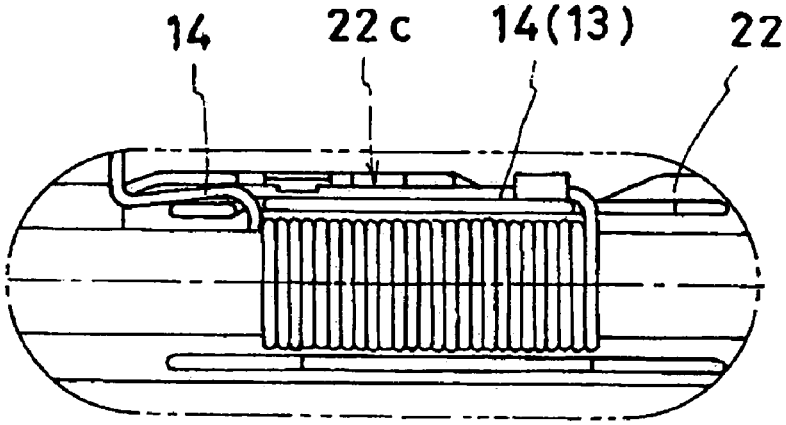
FIG. 10 is an enlarged view of a portion H shown in FIG. 9.

The assembling operation of the bumper antenna 10 will be explained with reference to FIGS. 8-10.

Figure 8A:
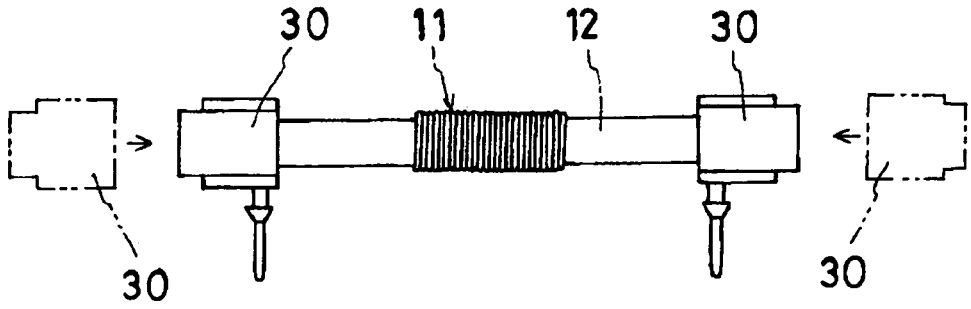
FIGS. 8A-8C are schematic views of assembling operation for the bumper antenna.

As shown in FIG. 8A, first, the elastic member 30 is fitted at each end of the antenna core 12 of the bar antenna 11.

Figure 8B:
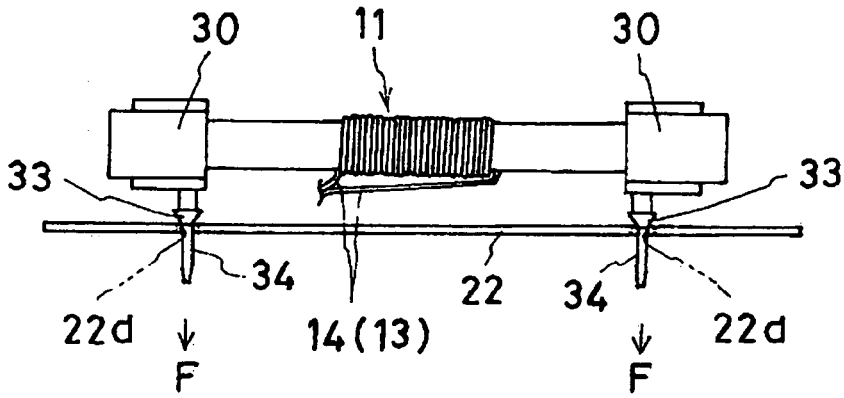
Figure 8C:
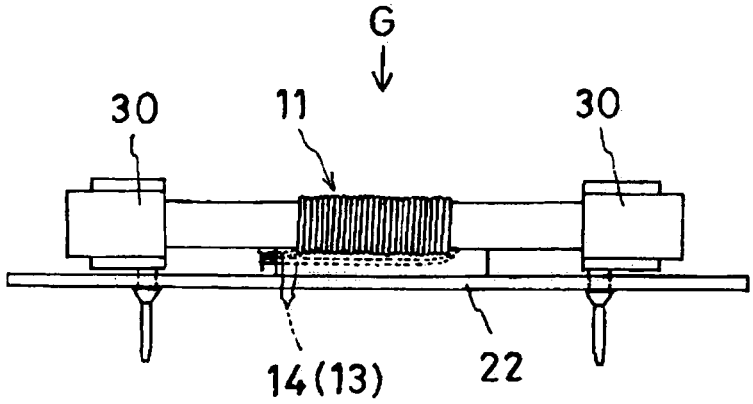

As shown in FIG. 8B, second, the handle portion 34 of the elastic member 30 is inserted into the attaching hole 22*d* formed on the cover 22. When the handle portion 34 inserted into the attaching hole 22*d* of the cover 22 is pulled towards arrow F of FIG. 8B, the wedge portion 33 of the elastic member 30 is elastically deformed and inserted into the attaching hole 22*d*, and eventually, the wedge portion 33 of the elastic member 30 is fitted to the attaching hole 22*d*. Thereafter, the leading end portion 14 of the wire 13 of the bar antenna 11 is housed in the holding portion 22*c* (shown in FIG. 6) shaped in a groove formed on the cover 22. At this point, as shown in FIGS. 8C, 9, 10, the elastic member 30 is fixed on the cover 22, and the leading end portion 14 of the wire 13 is held relative to the cover 22.

After assembling an adhesive tape, a protective tube, and a connector at a remaining portion of the leading end portion 14 of the wire 13, by fitting the cover 22 to the body 21, the bar antenna 11 is housed in the housing portion 21*a* of the body 21. Thus, the bar antenna 11 is held at the case 20 through the elastic member 30, and the assembling operation of the bumper antenna 10 is completed. Under a state where the bar antenna 11 is housed in the housing portion 21*a* of the body 21, the elastic member 30 fitted to the antenna core 12 of the bar antenna 11 contact an internal surface of the housing portion 21*a* with pressure. Accordingly, the elastic member 30 is press-fitted into the housing portion 21*a* of the body 21.

With the foregoing explanations of the embodiment of the present invention, the holding portion 22*c* formed on the cover 22 includes the groove. However, the construction of the holding portion 22*c* of the present invention is not limited to the groove configuration, and for example, may include a craw shape which can hold the leading end portion 14 of the wire 13 relative to the cover 22.

As explained above, according to the bumper antenna 10 of the present invention, the case 20 holds the bar antenna 11 through the elastic member 30. With this construction, impact and oscillation transmitted from the body panel 9 of the vehicle to the bar antenna 11 and the antenna core 12 is mitigated. The elastic member 30 is made from an elastic body made of rubber or elastomer, or the like. That is, because the elastic member 30 is solid when assembling to the antenna core 12, cure time (i.e., waiting time) of resin which is necessarily generated when holding the bar antenna 11 using potting material (i.e., resin) is not necessary. Accordingly, the time required to hold the bar antenna 11 at the case 20 is reduced, and the man-hour for assembling the bumper antenna 10 can be reduced.

Further, according to the embodiment of the present invention, the leading end portion 14 of the wire 13 coiled around the antenna core 12 of the bar antenna 11 is held by the holding portion 22*c* including the groove formed, in advance, on the cover 20. Accordingly, the wire 13 coiled around the antenna core 12 is unlikely unwound, and the bumper antenna 10 can be assembled efficiently, and the ease of assembly of the bumper antenna 10 is increased.

Further, according to the embodiment of the present invention, the wedge portion 33 and the handle portion 34 are provided in advance on the elastic member 30, and the attaching hole 22*d* fitted to the wedge portion 33 is provided on the case 20. By pulling the handle portion 34 after inserting the handle portion 34 to the attaching hole 22*d*, the wedge portion 33 is fitted to the attaching hole 22*d*, and thus the elastic member 30 is fixed to the case 20. With the foregoing construction, because the elastic member 30 and the case 20 are fixed to each other by means of snap-fit structure, it is not necessary to provide additional parts when fixing the elastic member 30 to the case 20. Accordingly, the number of parts of the bumper antenna 10 is reduced.

According to the embodiment of the present invention, the case holds the bar made of ferrite by means of the elastic member. With this construction, oscillation and impact transmitted from the body of the vehicle to the bar made of ferrite is mitigated. Further, because the elastic member is solid when being assembled, the cure time (i.e., waiting time) for resin which is generated with the known construction in which potting material (i.e., resin) is used and accounts for a part of man-hour for assembling operation of an antenna is not necessary. Accordingly, the bar made of ferrite can be held at the case with shorter time, and thus man-hour required for assembling the antenna can be reduced.

According to the embodiment of the present invention, the leading end portion of the wire coiled around the bar made of ferrite is held by the holding portion which is provided on the case in advance. With this construction, because the wire coiled around the bar made of ferrite is unlikely unwound, the antenna can be assembled efficiently, and ease of assembly of the antenna is increased.

According to the embodiment of the present invention, the fitting portion and the handle portion are formed on the elastic member in advance, and the attaching hole configured to be fitted to the fitting portion is provided at the case. By fitting the fitting portion to the attaching hole by pulling the handle portion after inserting the handle portion into the attaching hole, the elastic member is fixed to the case. Because the elastic member and the case are connected by means of a snap-fit structure, it is not necessary to provide separate parts for fixing the elastic member to the case. Accordingly, the number of parts for the antenna is reduced.

The principles, preferred embodiment and mode of operation of the present invention have been described in the foregoing specification. However, the invention which is intended to be protected is not to be construed as limited to the particular embodiment disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. An antenna device comprising:

a core portion made of magnetic material, the core portion being bar-shaped;

a wire coiled around the core portion leaving a leading end portion by a predetermined length;

a case holding the core portion on which the wire is coiled and fixed on a body of a vehicle;

the case comprising a cover;

an elastic member provided between the core portion and the case for holding the core portion relative to the case; and the elastic member comprising a fitting portion to which at least a part of the core portion is inserted to hold the core portion and an attaching portion which fixes the fitting portion to the case, the fitting portion of the elastic member contacting the cover of the case.

2. The antenna device according to claim 1, wherein the core portion is made of ferrite.

3. The antenna device according to claim 1, wherein the elastic member is made from an elastic body made of rubber or elastomer.

4. The antenna device according to claim 1, wherein the fitting portion is provided at an end of the core portion in a longitudinal direction thereof, and the end of the core portion is fitted into the fitting portion.

5. The antenna device according to claim 4, further comprising:

a projection formed on an internal surface of the fitting portion to which the end of the core portion is fitted; and wherein the projection presses the outer surface of the core portion.

6. The antenna device according to claim 4, wherein the attaching portion is formed on the fitting portion and extends in a direction which is perpendicular to a longitudinal direction of the core portion at a state where the core portion is fitted into the fitting portion.

7. The antenna device according to claim 5, wherein the attaching portion is formed on the fitting portion and extends in a direction which is perpendicular to a longitudinal direction of the core portion at a state where the core portion is fitted into the fitting portion.

8. The antenna device according to claim 4, wherein the attaching portion of the elastic member includes a wedge portion having a wedge shape and a handle portion formed continuously from the wedge portion;

the case is formed with an attaching hole fitted to the wedge portion; and the elastic member is fixed to the case by fitting the fitting portion to the attaching hole by pulling the handle portion after inserting the handle portion through the attaching hole.

9. The antenna device according to claim 5, wherein the attaching portion of the elastic member includes a wedge portion having a wedge shape and a handle portion formed continuously from the wedge portion;

the case is formed with an attaching hole fitted to the wedge portion; and the elastic member is fixed to the case by fitting the fitting portion to the attaching hole by pulling the handle portion after inserting the handle portion through the attaching hole.

10. The antenna device according to claim 6, wherein the attaching portion of the elastic member includes a wedge portion having a wedge shape and a handle portion formed continuously from the wedge portion;

the case is formed with an attaching hole fitted to the wedge portion; and the elastic member is fixed to the case by fitting the fitting portion to the attaching hole by pulling the handle portion after inserting the handle portion through the attaching hole.

11. The antenna device according to claim 7, wherein the attaching portion of the elastic member includes a wedge portion having a wedge shape and a handle portion formed continuously from the wedge portion;

the case is formed with an attaching hole fitted to the wedge portion; and the elastic member is fixed to the case by fitting the fitting portion to the attaching hole by pulling the handle portion after inserting the handle portion through the attaching hole.

12. The antenna device according to claim 1, further comprising:

a projection formed on an internal surface of the fitting portion to which an end of the core portion is fitted; and wherein the projection presses the outer surface of the core portion.

13. The antenna device according to claim 12, wherein the attaching portion is formed on the fitting portion and extends in a direction which is perpendicular to a longitudinal direction of the core portion at a state where the core portion is fitted into the fitting portion.

14. The antenna device according to claim 12, wherein the attaching portion of the elastic member includes a wedge portion having a wedge shape and a handle portion formed continuously from the wedge portion;

the case is formed with an attaching hole fitted to the wedge portion; and the elastic member is fixed to the case by fitting the fitting portion to the attaching hole by pulling the handle portion after inserting the handle portion through the attaching hole.

15. The antenna device according to claim 13, wherein the attaching portion of the elastic member includes a wedge portion having a wedge shape and a handle portion formed continuously from the wedge portion;

the case is formed with an attaching hole fitted to the wedge portion; and the elastic member is fixed to the case by fitting the fitting portion to the attaching hole by pulling the handle portion after inserting the handle portion through the attaching hole.

16. The antenna device according to claim 1, wherein the attaching portion is formed on the fitting portion and extends in a direction which is perpendicular to a longitudinal direction of the core portion at a state where the core portion is fitted into the fitting portion.

17. The antenna device according to claim 16, wherein the attaching portion of the elastic member includes a wedge portion having a wedge shape and a handle portion formed continuously from the wedge portion;

the case is formed with an attaching hole fitted to the wedge portion; and the elastic member is fixed to the case by fitting the fitting portion to the attaching hole by pulling the handle portion after inserting the handle portion through the attaching hole.

18. The antenna device according to claim 1, wherein the attaching portion of the elastic member includes a wedge portion having a wedge shape and a handle portion formed continuously from the wedge portion;

the case is formed with an attaching hole fitted to the wedge portion; and the elastic member is fixed to the case by fitting the fitting portion to the attaching hole by pulling the handle portion after inserting the handle portion through the attaching hole.

19. The antenna device according to claim 1, further comprising:

a holding portion provided in the case which holds the leading end portion of the wire.

20. The antenna device according to claim 1, wherein the cover of the case comprises a holding portion that includes a groove formed in a thickness direction of the case.

* * * * *